United States Patent [19]

Kade

[11] Patent Number: 4,867,847

[45] Date of Patent: Sep. 19, 1989

[54] EXPANDING BODY FOR USE IN A HEADBOX OR A STATIONARY SUPPORT DEVICE

[75] Inventor: Werner Kade, Heidenheim, Fed. Rep. of Germany

[73] Assignee: J.M. Voith GmbH, Heidenheim, Fed. Rep. of Germany

[21] Appl. No.: 232,920

[22] Filed: Aug. 16, 1988

[30] Foreign Application Priority Data

Aug. 26, 1987 [DE] Fed. Rep. of Germany ..... 3728387

[51] Int. Cl.[4] ..... D21F 1/02; D21F 1/54

[52] U.S. Cl. ..... 162/289; 162/336; 162/344; 162/352

[58] Field of Search ..... 162/336, 344–347, 162/352; 425/381, 466; 248/180, 631, 638, 654

[56] References Cited

U.S. PATENT DOCUMENTS

| | | | |
|---|---|---|---|
| 2,928,464 | 3/1960 | Western et al. | 162/344 |
| 3,017,930 | 1/1962 | Dunlap | 162/352 |
| 3,027,940 | 4/1962 | Dunlap | 162/352 |
| 3,497,420 | 2/1970 | Clark | 162/352 |
| 4,162,937 | 7/1979 | Corbellini | 162/352 |
| 4,358,347 | 11/1982 | Nuttall | 162/347 |

*Primary Examiner*—Karen Hastings

*Attorney, Agent, or Firm*—Albert L. Jeffers; Richard L. Robinson

[57] ABSTRACT

Expanding body which is essentially designed as a hollow beam and, viewed in the cross-section, composed of several flexible walls. At least one of these walls has a higher expandability than the other walls. The internal chamber of the expanding body can be pressurized by a variable fluid pressure. On the use of such an expanding body in a paper machine headbox a wall with a relatively low expandability forms the downstream end piece of a flow guide wall. Its position, which determines the clear width of the discharge opening, is alterable by varying the internal pressure.

20 Claims, 2 Drawing Sheets

Fig. 5
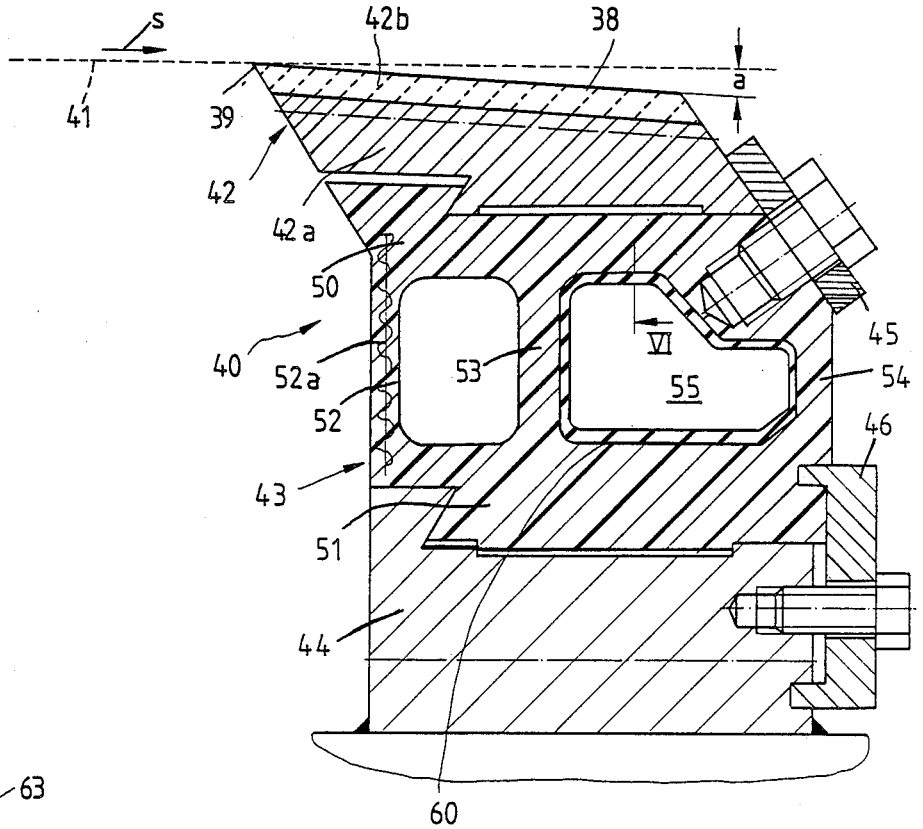
Fig. 6
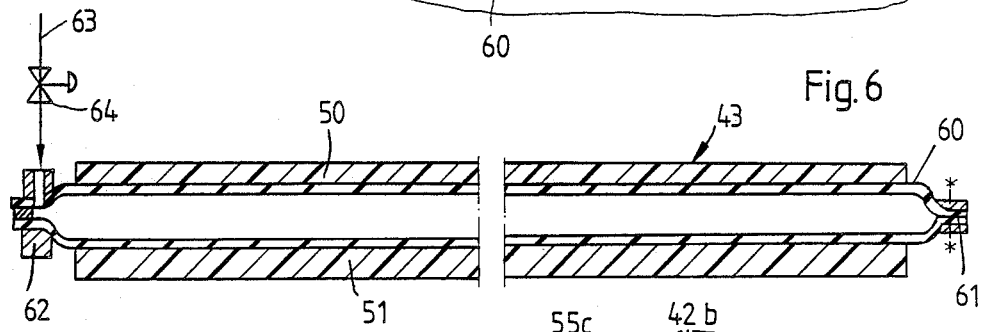
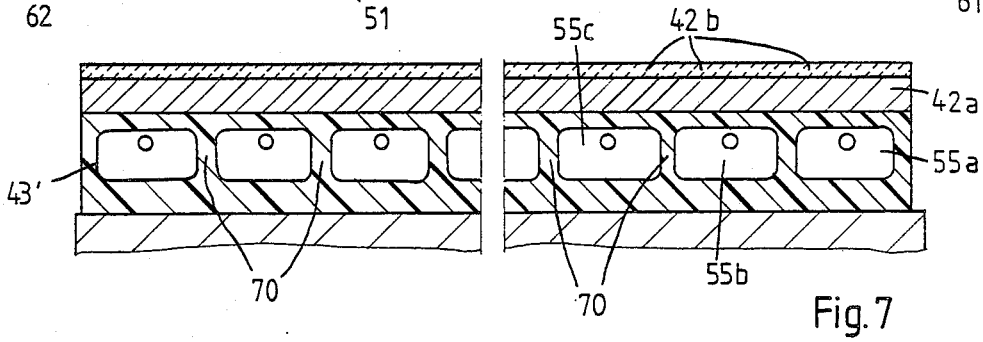
Fig. 7

EXPANDING BODY FOR USE IN A HEADBOX OR A STATIONARY SUPPORT DEVICE

BACKGROUND OF THE INVENTION

The invention relates to an expanding body which extends across the width of a machine (e.g. a papermaking or converting machine or a similar machine) and is used on this for changing the position of a machine element, e.g. strip, profile bar or the like. The walls of the expanding body shaped similar to a box are formed from a flexible material; they confine an inner chamber which can be pressurized by a medium so that at least one of the walls, viewed in the cross-section through the expanding body, is expanded in the longitudinal direction.

Such an expanding body has been proposed in Federal Republic of Germany Patent Application Serial No. P 37 10 058.0. It is arranged at the discharge opening of a headbox and carries a blade-like bar, which is slidable at right angles to the stock flow for the purpose of altering the clear width of the discharge opening. The sliding of the bar is effected in that the inner chamber of the expanding body can be pressurized with variable pressure by a pressure medium. Viewed in a cross-section, the expanding body has four walls, which confine the inner chamber. Two opposing walls extend in the direction of movement of the bar parallel to each other. These two walls and the cross wall arranged at a distance from the bar are supported from the outside by rigid components. The cross wall located in the vicinity of the bar can be stiffened by an armoring. In this case, the walls parallel to each other have a higher expandability than the stiffened cross wall, which is free on its outside, i.e. not supported. By variation of the pressure prevailing in the inner chamber of the expanding body the two walls parallel to each other can expand more or less in the direction of movement of the bar, whereby the externally free cross wall is adjusted together with the bar. Since the inner chamber is subdivided by means of a plurality of cross walls into several sections which are disposed one behind the other in machine cross direction, and since each section can be pressurized individually by a variable fluid pressure, the bar can be adjusted by different amounts from section to section.

A disadvantage of the proposed design is that the two highly expandable walls parallel to each other must slide along the rigid components supporting them. This generates friction forces at the sliding surfaces This makes it very difficult to precisely pre-determine the position change of the bar resulting from a well-defined change of the internal pressure.

SUMMARY OF THE INVENTION

The invention is based on the task of further designing the proposed expanding body to make it more versatile than hitherto. At the same time, it is to be avoided that two parallel sliding surfaces are necessary for support of the expanding body, so that the change of the position of the machine element joined to the expanding body can be done with greater accuracy than hitherto.

This task is solved by the features of the present invention in which the mainly box-shaped expanding body has, viewed in the cross-section, two walls connected to each other, which are both on their outside, at least predominantly, free from rigid, supporting components. Thus the corner at which these two walls are connected to each other, viewed in the cross-section, is freely movable towards all directions. The important thing is that one of these two walls (whose outsides ar at least mainly free from supporting components) is the highly expandable wall, i.e., the expandability of this wall should be substantially higher than the expandability of the other, non-supported wall. In this way it is avoided that the outside of the highly expandable wall slides on a supporting component on a change of the internal pressure. The consequence is that the magnitude of the position change of the machine element concerned can be pre-determined and reproduced substantially more accurately than hitherto on the basis of a change of the internal pressure.

In addition, it is achieved that fewer walls than hitherto have to be supported or guided from outside by a metallic structural member. The lack of an external support can be compensated for, for example, by only relatively low pressure differences existing in operation on both sides of the wall concerned. Or a wall area not supported from outside and relatively little expandable is, for example, reinforced by an armoring. In this way it can be inserted as a self-supporting structural member without the need for a metallic supporting or guiding surface.

In the preferred embodiments of the invention the expanding body has, viewed in the cross-section, only one single highly expandable wall, i.e., all other walls have a low expandability (e.g. by insertion of an armoring) and/or are firmly connected with rigid, preferably metallic structural members. In this way, the movable wall is no longer slidable as a whole, as in the subject of German P No. 37 10 058.0. Rather, the movable wall is now mainly swivellable, i.e. about a swivel axis, which lies in the area of the connecting point, at which the movable wall and the adjacently connecting wall supported by a rigid element go into each other.

The swivellable wall can itself be the said machine element whose position is to be determined or altered. For example, the swivellable wall may be a piece of an adjustable flow guide wall of a headbox. Another machine element to be adjusted (strip, profile bar or the like) can also be coupled to the swivellable wall.

BRIEF DESCRIPTION OF THE DRAWINGS

The advantageous embodiments and applications of the expanding body according to the invention described herein are described below with reference to the drawings.

FIG. 5 shows the application of an expanding body according to the invention in a stationary supporting device for a paper machine wire belt, represented in the cross-section.

FIG. 6 shows a reduced-size partial longitudinal section along the line VI of FIG. 5.

FIG. 7 shows a longitudinal section through an embodiment modified as compared with FIGS. 5 and 6.

DESCRIPTION OF THE PREFERRED EMBODIMENTS

Figure 1:
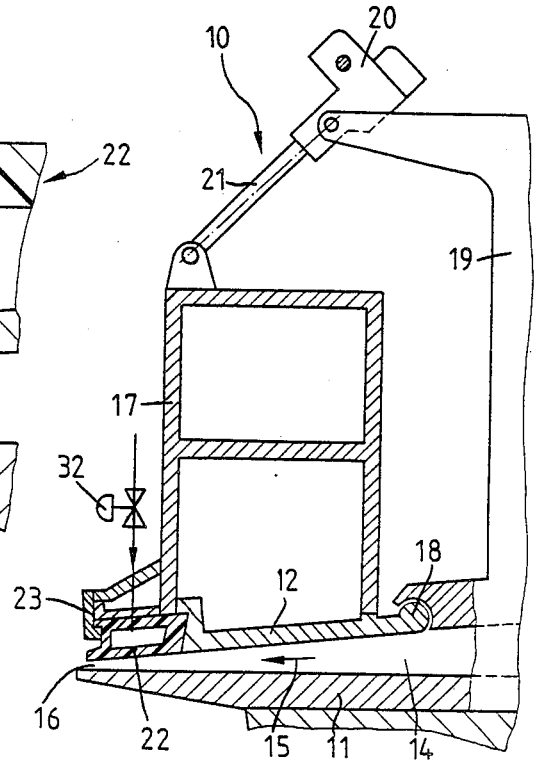
FIG. 1 shows the application of an expanding body according to the invention in a paper machine headbox.

FIG. 1 shows the area around the discharge nozzle of a headbox, which altogether is designated with 10. It has a rigid, approximately horizontally running bottom flow guide wall 11 and a movable top flow guide wall 12. These two machine-wide and converging flow guide walls 11 and 12 define a machine-wide, nozzle-like discharge duct 14 for a fiber suspension which flows as machine-wide stock flow (flow direction 15) through the discharge opening 16 in the known way to a paper machine wire belt to form a paper web there. The movable top flow guide wall 12, which is stiffened by a box-shaped beam 17, is swivellably supported by means of a joint 18 at the housing 19 of the headbox 10. The beam 17 is also connected by means of a lifting unit (spindle 21 and gear unit 20) to the housing 19. With the help of this lifting device the clear width of the discharge opening 16 can be coarsely adjusted.

The downstream end piece 22 of the movable top flow guide wall 12 is a box-shaped expanding body which extends along the discharge opening 16 across the entire machine width. It is clamped by means of a clamping strip 23 into a corresponding recess, which is jointly confined by the flow guide wall 12 and the beam 17. The expanding body is manufactured from a highly flexible material, e.g. plastic, and has, viewed in the cross-section as per FIG. 2, the shape of a hollow beam with a top wall 24, a rear wall 25, a bottom wall 26 and a front wall 27. With the walls 24 and 25 the expanding body 22 rests on the already mentioned parts 12 and 17. A projection 24*a* makes possible the secure fastening by means of the mentioned clamping strip 23. The bottom wall 26 forms a continuous extension of the flow guide wall 12. The front wall 27 is arranged at right angles to this, i.e. running from top to bottom, and has a higher expandability than the other walls 24 to 26 or at least higher than the swivellable bottom wall 26. This higher expandability can be achieved by a higher flexibility and/or by a wall thickness reduced as compared with the other walls. A higher flexibility of the front wall 27 can be gained, for example, in that the other walls 24, 25 and 26 are stiffened by means of an armoring (symbolically shown by a wavy line 28) and omitting such an armoring in the front wall 27. It may, however, also be adequate to make only the rear wall 25 and the bottom wall 26 (e.g. by means of an armoring) less expandable than the other walls 24 and 27; i.e. in the top wall 24 (which is firmly clamped in from all sides) the armoring 28 could be omitted. The rear wall 25 must be particularly rigid (i.e. minimally expandable) so that no offset is formed at the joint between the walls 12 and 26.

Figure 3:
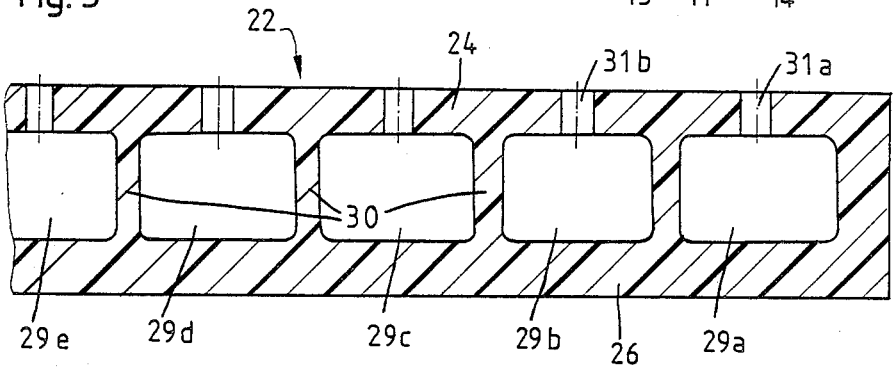
FIG. 3 shows a partial longitudinal section according to line III of FIG. 2.

During operation the inner chamber 29 is continuously filled with a pressure medium, e.g. water. By variation of the pressure the front wall 27 lengthens more or less so that the downstream part of the bottom wall 26 slopes more or less downwards, e.g. into a position which is indicated with chain lines in FIG. 2. In this way the clear width of the discharge opening 16 can be altered very sensitively. As can be seen from FIG. 3, the expanding body has a plurality of cross walls 30 by which the inner chamber is subdivided into several partial chambers 29*a*, 29*b*, 29*c*, etc. In each of these partial chambers terminates a corresponding pressure fluid supply pipe 31*a*, 31*b*, etc. with one control valve 32 each (as symbolically shown in FIG. 1). In this way the clear width of the discharge opening can be reduced by adjustment of different pressures in the partial chambers 29*a*, 29*b*, etc. at a number of points across the machine width, more at some points and less at other points. This is called "local fine adjustment".

Figure 4:
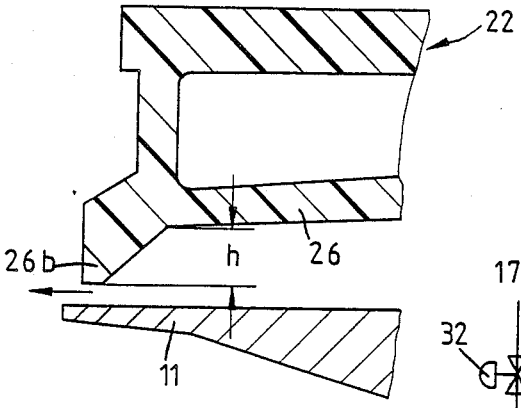
FIG. 4 shows a detail of a design modified compared with FIG. 1.
Figure 2:
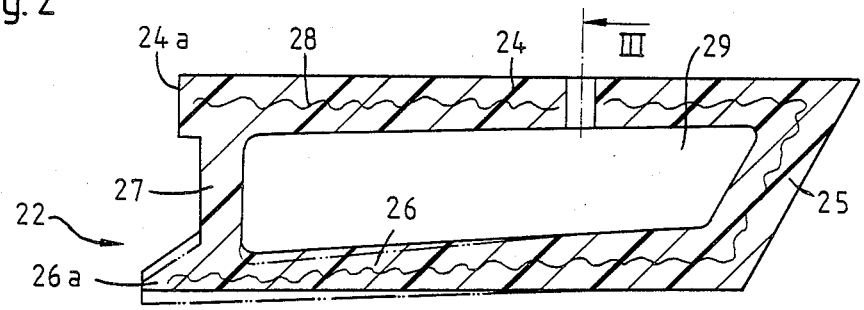
FIG. 2 shows the expanding body of FIG. 1 on an enlarged scale, in a cross-section.

According to FIGS. 1 and 2 the outside of the bottom wall 26 contacted by the flow runs mainly flat up to the lip-like end 26*a*. Deviating from this, as per FIG. 4, a profile-barlike strip 26*b* can be formed on the downstream end of the bottom wall 26. Known headboxes have a profile bar slidable relative to the flow guide wall in order to be able to vary the so-called profile-bar projection h (FIG. 4). For this, as is known, a large number of adjusting rods are available, distributed uniformly over the length of the profile bar. These are used for "local fine adjustment", with only one of the rods being actuated or only a few of the rods being actuated. Or the rods are used for a uniform variation of the profile-bar projection h across the entire machine width, with all rods being actuated simultaneously. In a similar way, the profile-bar projection h on the headbox mentioned above, described in Federal Republic of Germany Patent Application No. P 37 10 058.0 can be varied. In contrast to this, according to the invention, the "local fine adjustment", as described above, can be accomplished without altering the profile-bar projection h. A uniform variation of the profile-bar projection h can be effected in that the expanding body is exchanged for another one with a different dimension h. If required, the outside of the expanding body 22 contacted by the stock flow can be completely or partially (e.g. in the area of the lip-like end 26*a*, FIG. 2, or in the area of the strip 26*b*, FIG. 4) protected against wear by means of a thin metal layer (not shown in the drawing).

FIG. 5 shows a stationary supporting device 40, also called "foil", for the traveling drainage wire belt 41 of a paper machine (direction of travel of the wire belt marked with S). Previous embodiments of such supporting devices are described in Federal Republic of Germany Patent Application Serial No. P 36 28 282.0 and in the publications cited therein. The principal element of such a foil is a so-called head bar 42. This has a leading edge 39 similar to a doctor, contacting the underside of the wire belt 41, and a dewatering surface 38 which makes a variable angle of inclination "a" with the direction of travel of the wire belt. The head bar 42 extending at right angles to the direction of wire travel across the entire machine width comprises, for example, a base body 42*a* and a number of hard ceramic platelets 42*b* fastened to it (see also FIG. 7).

The head bar 42 rests, with the interposition of an expanding body 43 on a foot bar 44. Both elements, the expanding body 43 and the foot bar 44, extend also at right angles across the entire machine width. For connection of the head bar 42 to the expanding body 43 and of the expanding body to the foot bar 44 the shown clamping strips 45 or 46 and the associated screws can, for example, be used.

The expanding body 43 is in turn configured as a hollow beam and formed from an elastic material, preferably from a plastic. In the example shown the expanding body has a top wall 50 and a bottom wall 51, which are connected by means of a front wall 52, a middle wall 53 and a rear wall 54. The internal chamber 55 located between middle wall 53 and rear wall 54 is, as shown in FIG. 6, open outwards at its two ends and lined by a hose 60. The hose 60 projects at both ends a little way over the expanding body 53 and is closed there by means of clamps 61 or 62. To one of the clamps 62 can be connected a pressure medium pipe 63 with a control valve 64.

The rear wall 54 of the expanding body 43 has a higher expandability (e.g. because of a smaller wall thickness) than the other walls. By the supply of a pressure medium into the internal chamber 55, more precisely into the interior of the hose 60, the rear wall 54 lengthens in the direction towards the wire belt 41. By an increase in the fluid pressure the angle of inclination "a" can therefore be reduced. The advantage of the described mode of construction as compared with the known designs lies mainly in the fact that much fewer individual parts are needed than previously. No mechanical structural elements sliding on one another are required for adjustment of the angle of inclination. Compared with the known type as per U.S. Pat. No. 3,497,420, a major advantage consists in the fact that the uppermost layer of the head box contacted by the wire belt, as known from other publications, can be formed by a wear-resistant ceramic plating. **42*b***.

Due to the fact that the internal chamber 55 is not closed at its ends by cross walls and instead is lined by the hose 60, the top wall 50 (by a pressure change in the hose) can be swivelled completely uniformly over its length (same swivel angle across the entire machine width).

A variation of the angle of inclination "a" should result in a vertical shifting as small as possible of the leading edge 39. For this reason, the expandability of the front wall 52 is as low as possible (e.g. by the installation of a rigid armoring **52*a*). The expandability of the middle wall 53 is adjusted preferably to a medium value (between the expandability values of the front wall 52 and the rear wall 54**).

The supporting device shown in FIG. 7 with expanding body 43' varies from FIGS. 5 and 6 by the following features: the internal chamber of the expanding body confined by the rear wall 54 (FIG. 5) is subdivided by several cross walls 70 into partial chambers **55*a*, 55*b*, etc., which follow each other in succession across the machine width. Similar to the way shown in FIG. 3, each partial chamber can be pressurized by a selectable fluid pressure. This makes it possible to adjust the angle of inclination "a" in the various zones to values which vary only to a minor extent from one another. It was found that this is possible due to the fact that the uppermost layer of the head bar (whose base body is again designated with 42*a*) is composed of relatively small ceramic pieces 42*b*. As per FIG. 7, the length of each of the ceramic pieces 42*b* is approximately the same as the distance of cross wall 30 to cross wall 30**. This is, however, not an absolute requirement.

What is claimed is:

1. In a machine, an expanding body extending across the entire width of the machine for processing webs and used therein for changing the position of a machine element, said expanding body viewed in the cross-section comprising:

a box having several walls together defining an inner chamber, each wall having an inside defining the inner chamber and an outside, at least one of said walls being movable relative to said machine, at least another one of said walls being supported from the outside by a rigid structural component of said machine, at least one of said walls having a higher expandability than and being connected to said at least one wall supported from the outside and to said at least one movable wall, wherein at least a major part of the outside of said at least one wall of higher expandibility is free from supporting structural components of said machine; and means for pressurizing by a pressure agent said inner chamber so that the position of said machine element is determinable by the level of the pressure of the pressure agent.

2. An expanding body according to claim 1, in which said box has only one of said at least one wall of higher higher expandibility.

3. An expanding body according to claim 1, in which said box is subdivided into several portions arranged one behind the other in machine cross direction.

4. An expanding body according to claim 2, in which said box is subdivided into several portions arranged one behind the other in machine cross direction.

5. An expanding body according to claim 1, in which the internal chamber is subdivided by a plurality of cross walls into several portions with each portion being capable of being pressurized individually by a variable fluid pressure.

6. An expanding body according to claim 2, in which the internal chamber is subdivided by a plurality of cross walls into several portions with each portion being capable of being pressurized individually by a variable fluid pressure.

7. An expanding body according to claim 1, in which said box is free from lateral face walls and including a hose lining said internal chamber, said internal chamber together with the hose extending across the entire machine width.

8. An expanding body according to claim 2, in which said box is free from lateral face walls and including a hose lining said internal chamber, said internal chamber together with the hose extending across the entire machine width.

9. An expanding body according to claim 2, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width of the discharge opening changes.

10. An expanding body according to claim 3, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width of the discharge opening changes.

11. An expanding body according to claim 4, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width of the discharge opening changes.

12. An expanding body according to claim 5, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width o the discharge opening changes.

13. An expanding body according to claim 6, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width of the discharge opening changes.

14. An expanding body according to claim 7, in which the movable wall forms a downstream end piece of a flow guide wall of a paper machine headbox having a discharge opening, and in part defines the discharge opening of the headbox, the movable wall having a relatively low expandability, said highly expandable wall being arranged transversely and disposed at the downstream end of the expanding body, with the movable wall being swivellable by a change in the pressure prevailing in the internal chamber in such a way that the clear width of the discharge opening changes.

15. An expanding body according to claim 9, in which the end piece of the flow guide wall is shaped as a blade-like bar.

16. An expanding body according to claim 1, in which said box is located in a stationary supporting device for a traveling wire belt of a paper machine as a supporting bar for a head bar having a leading edge, a trailing edge, and a dewatering surface which makes a variable angle of inclination with the direction of travel of the wire belt, said box having a wall of relatively low expandability arranged underneath the leading side of the supporting device and transversely to the dewatering surface, said at least one wall of higher expandability arranged underneath the trailing side of the supporting device and transversely to the dewatering surface, the head bar being connected so rigidly to the expanding body that, because of the said high expandability of the trailing wall, a change in the said angle of inclination takes place by a change of the pressure prevailing in the internal chamber.

17. An expanding body according to claim 2, in which said box is located in a stationary supporting device for a traveling wire belt of a paper machine as a supporting bar for a head bar having a leading edge, a trailing edge, and a dewatering surface which makes a variable angle of incline with the direction of travel of the wire belt, said box having a wall of relatively low expandability arranged underneath the leading side of the supporting device and transversely to the dewatering surface, said at least one wall of higher expandability arranged underneath the trailing side of the supporting device and transversely to the dewatering surface, the head bar being connected so rigidly to the expanding body that, because of the said high expandability of the trailing wall, a change in the said angle of inclination takes place by a change of the pressure prevailing in the internal chamber.

18. An expanding body according to claim 3, in which said box is located in a stationary supporting device for a traveling wire belt of a paper machine as a supporting bar for a head bar having a leading edge, a trailing edge, and a dewatering surface which makes a variable angle of inclination with the direction of travel of the wire belt, said box having a wall of relatively low expandability arranged underneath the leading side of the supporting device and transversely to the dewatering surface, said at least one wall of higher expandability arranged underneath the trailing side of the supporting device and transversely to the dewatering surface, the head bar being connected so rigidly to the expanding body that, because of the said high expandability of the trailing wall, a change in the said angle of inclination takes place by a change of the pressure prevailing in the internal chamber.

19. An expanding body according to claim 5, in which said box is located in a stationary supporting device for a traveling wire belt of a paper machine as a supporting bar for a head bar having a leading edge, a trailing edge, and a dewatering surface which makes a variable angle of inclination with the direction of travel of the wire belt, said box having a wall of relatively low expandability arranged underneath the leading side of the supporting device and transversely to the dewatering surface, said at least one wall of higher expandability arranged underneath the trailing side of the supporting device and transversely to the dewatering surface, the head bar being connected so rigidly to the expanding body that, because of the said high expandability of the trailing wall, a change in the said angle of inclination takes place by a change of the pressure prevailing in the internal chamber.

20. An expanding body according to claim 7, in which said box is located in a stationary supporting device for a traveling wire belt of a paper machine as a supporting bar for a head bar having a leading edge, a trailing edge, and a dewatering surface which makes a variable angle of inclination with the direction of travel of the wire belt, said box having a wall of relatively low expandability arranged underneath the leading side of the supporting device and transversely to the dewatering surface, said at least one wall of higher expandability arranged underneath the trailing side of the supporting device and transversely to the dewatering surface, the head bar being connected so rigidly to the expanding body that, because of the said high expandability of the trailing wall, a change in the said angle of inclination takes place by a change of the pressure prevailing in the internal chamber.

* * * * *